US010889882B2

(12) United States Patent
Kadali et al.

(10) Patent No.: US 10,889,882 B2
(45) Date of Patent: Jan. 12, 2021

(54) HIGH STRENGTH AND CORROSION RESISTANT ALLOY FOR USE IN HVAC AND R SYSTEMS

(71) Applicant: Novelis Inc., Atlanta, GA (US)

(72) Inventors: Jyothi Kadali, Woodstock, GA (US); Eider Alberto Simielli, Kennesaw, GA (US); Kevin Michael Gatenby, Johns Creek, GA (US)

(73) Assignee: Novelis Inc., Atlanta, GA (US)

( * ) Notice: Subject to any disclaimer, the term of this patent is extended or adjusted under 35 U.S.C. 154(b) by 226 days.

(21) Appl. No.: 15/448,974

(22) Filed: Mar. 3, 2017

(65) Prior Publication Data

US 2017/0342536 A1 Nov. 30, 2017

Related U.S. Application Data

(60) Provisional application No. 62/342,723, filed on May 27, 2016.

(51) Int. Cl.
*C22C 21/14* (2006.01)
*C22F 1/05* (2006.01)
(Continued)

(52) U.S. Cl.
CPC ..... *C22F 1/05* (2013.01); *C22C 21/04* (2013.01); *C22C 21/06* (2013.01); *C22C 21/08* (2013.01);
(Continued)

(58) Field of Classification Search
None
See application file for complete search history.

(56) References Cited

U.S. PATENT DOCUMENTS 4,645,544 A * 2/1987 Baba ..... C22F 1/05 148/415
5,176,205 A * 1/1993 Anthony ..... B23K 35/286 165/133
(Continued)

FOREIGN PATENT DOCUMENTS

BY 7766 2/2006
CA 3022456 11/2017
(Continued)

OTHER PUBLICATIONS

"International Alloy Designations and Chemical Composition Limits for Wrought Aluminum and Wrought Aluminum Alloys," Registration Record Series: Teal Sheets, Feb. 1, 2009, The Aluminum Association, Inc., 35 pages.
(Continued)

*Primary Examiner* — Daniel J. Schleis
(74) *Attorney, Agent, or Firm* — Kilpatrick Townsend & Stockton LLP

(57) ABSTRACT

Provided herein are new aluminum alloy materials which are useful in replacing copper in a heat exchanger. The aluminum alloy materials are also useful in manufacturing components of heating, ventilating, air-conditioning, and refrigeration (HVAC&R) systems for indoor and outdoor units. The alloys are well-suited for tubing in a heat exchanger. The alloys display high strength and good corrosion resistance. Also provided herein are methods for making the aluminum alloy materials.

14 Claims, 11 Drawing Sheets

(51) Int. Cl.

| | |
|---|---|
| ***C22C 21/16*** | (2006.01) |
| ***C22C 21/06*** | (2006.01) |
| ***C22F 1/04*** | (2006.01) |
| ***C22C 21/12*** | (2006.01) |
| ***C22C 21/04*** | (2006.01) |
| ***C22C 21/08*** | (2006.01) |
| ***C22F 1/047*** | (2006.01) |
| ***F28F 1/12*** | (2006.01) |
| ***F28F 19/00*** | (2006.01) |
| ***F28F 21/08*** | (2006.01) |
| *C22F 1/057* | (2006.01) |

(52) U.S. Cl.

CPC ..... *C22C 21/12* (2013.01); *C22C 21/14* (2013.01); *C22C 21/16* (2013.01); *C22F 1/04* (2013.01); *C22F 1/047* (2013.01); *F28F 1/12* (2013.01); *F28F 19/00* (2013.01); *F28F 21/084* (2013.01); *C22F 1/057* (2013.01); *F28F 2215/00* (2013.01); *Y10T 428/12764* (2015.01)

(56) References Cited

U.S. PATENT DOCUMENTS

| | | | | |
|---|---|---|---|---|
| 6,921,584 | B2 * | 7/2005 | Syslak | B23K 35/0238 428/654 |
| 7,608,345 | B2 * | 10/2009 | Burger | B23K 35/00 148/523 |
| 9,714,799 | B2 * | 7/2017 | Oskarsson | B22D 21/007 |
| 9,964,364 | B2 | 5/2018 | Ren | |
| 2001/0025676 | A1 * | 10/2001 | Taguchi | C22C 21/00 148/689 |
| 2005/0199318 | A1 * | 9/2005 | Doty | B22D 21/007 148/439 |
| 2006/0078728 | A1 | 4/2006 | Kilmer | |
| 2006/0105193 | A1 | 5/2006 | Bürger et al. | |
| 2008/0056931 | A1 | 3/2008 | Connor et al. | |
| 2008/0118393 | A1 | 5/2008 | Oskarsson et al. | |
| 2008/0274367 | A1 * | 11/2008 | Kilmer | B23K 35/0238 428/607 |
| 2013/0302642 | A1 * | 11/2013 | Ren | B23K 35/0238 428/654 |
| 2014/0272460 | A1 * | 9/2014 | Howells | F28F 21/084 428/654 |
| 2017/0260612 | A1 * | 9/2017 | Janssen | C22F 1/04 |
| 2018/0003450 | A1 * | 1/2018 | Garosshen | F28F 21/084 |

FOREIGN PATENT DOCUMENTS

| | | | |
|---|---|---|---|
| CN | 101039802 | | 9/2007 |
| EP | 2065180 | * | 6/2009 |
| JP | S62122744 | | 6/1987 |
| JP | 0835045 | | 2/1996 |
| JP | 2008517152 | | 5/2008 |
| RU | 2451565 | | 5/2012 |
| RU | 130059 | | 7/2013 |
| WO | WO2006039304 | * | 4/2006 |

OTHER PUBLICATIONS

International Patent Application No. PCT/US2017/020635, International Search Report and Written Opinion dated May 18, 2017, 10 pages.
Australian Application No. 2017269097 , "Notice of Acceptance", dated Jun. 4, 2019, 3 pages.
Chinese Application No. 201780003516.3 , "Office Action", dated May 23, 2019, 19 pages.
Japanese Application No. 2018-519752 , "Office Action", dated Jun. 4, 2019, 6 pages.
Australian Application No. 2017269097 , "First Examination Report", dated Mar. 6, 2019, 3 pages.
Canadian Application No. 3,001,504 , "Office Action", dated Apr. 30, 2019, 5 pages.
Russian Application No. 2018113754 , "Office Action", dated Aug. 9, 2019, 13 pages.
Canadian Patent Application No. 3,001,504 , "Office Action", dated Jan. 23, 2020, 3 pages.
Chinese Application No. 201780003516.3 , "Office Action", dated Nov. 20, 2019, 11 pages.
European Application No. 17711932.8 , "Office Action", dated Oct. 16, 2019, 6 pages.
Korean Application No. 10-2018-7011359 , "Office Action", dated Dec. 18, 2019, 12 pages.
Russian Application No. 2018113754 , "Notice of Decision to Grant", dated Nov. 15, 2019, 14 pages.
"Aluminum Handbook", General Incorporated Association, Japan Aluminium Association, Standard Committee, 7th Edition, Jan. 31, 2007, p. 16.
Japanese Application No. 2018-519752, "Office Action", dated Feb. 25, 2020, 15 pages.
Korean Application No. 10-2018-7011359, "Office Action", dated Feb. 24, 2020, 7 pages.
Chinese Application No. 201780003516.3, "Third Office Action," dated Mar. 13, 2020, 12 pages.
Korean Patent Application No. 10-2018-7011359 , "Office Action", dated Apr. 28, 2020, 9 pages.
Chinese Application No. CN201780003516.3, Office Action, dated Jun. 24, 2020, 7 pages.
European Application No. EP17711932.8, Notice of Decision to Grant, dated Jul. 16, 2020, 2 pages.
Korean Application No. KR10-2018-7011359, Notice of Decision to Grant, dated Jul. 21, 2020, 2 pages.
Canadian Application No. 3,001,504, Notice of Allowance, dated Oct. 20, 2020, 1 page.
Indian Application No. 201817013838, First Examination Report, dated Aug. 24, 2020, 7 pages.

* cited by examiner

HIGH STRENGTH AND CORROSION RESISTANT ALLOY FOR USE IN HVAC AND R SYSTEMS

CROSS-REFERENCE TO RELATED APPLICATION

This application claims the benefit of U.S. Provisional Application No. 62/342,723, filed May 27, 2016, which is incorporated herein by reference in its entirety.

FIELD

This disclosure relates to the fields of material science, material chemistry, metallurgy, aluminum alloys, aluminum fabrication, and related fields. More specifically, the disclosure provides novel aluminum alloys that can be used in a variety of applications, including but not limited to manufacturing components of heating, ventilating, air-conditioning, and refrigeration (HVAC&R) systems for indoor and outdoor units.

BACKGROUND

Metal components of HVAC&R systems are prone to exhibiting corrosion over time. One specific example is metal tubing. For nearly a century, metal tubing in HVAC&R systems has been made of copper, and corrosion attack of copper tubing has long been a significant problem having substantial cost impact. Corrosion in tubes can lead to reduced performance of the system. Specifically, galvanic corrosion between the tube and the fin can lead to tube leakages, which causes the unit performance to decline.

Alternative methods that increase performance, energy efficiency, and durability of HVAC&R components are desirable. Most of the HVAC&R and refrigeration equipment designs are based on round tube-plate fin designs. This basic design has been in use for nearly 100 years. The concept has been enhanced in various ways to achieve higher heat transfer performance. Aluminum-based solutions, in particular, offer design advantages that provide many benefits. For example, in aluminum heat exchangers, tube corrosion occurs far slower than in a mixed metal-copper tube and aluminum fins in the unit due to a closer galvanic balance between the fin and the tube. However, a demand remains for better performance.

The desired performance can be achieved by substituting copper tubes with other materials. Current substitutes for HVAC&R copper tubing include aluminum clad tubes and zinc coated tubes. However, aluminum clad tubes require additional processing steps because of the clad layer, which increases the price. Similar issues exist for zinc coated tubes due to the additional sparing step. Moreover, the corrosion life for zinc coated tubes is depleted once the zincated layer corrodes during service.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings and each claim.

Provided herein are novel aluminum alloys that are well-suited for replacing copper in a variety of applications, including plumbing applications, HVAC&R applications, automotive applications, industrial applications, transportation applications, electronics applications, aerospace applications, railway applications, packaging applications and others.

The aluminum alloys disclosed herein are suitable substitutes for metals conventionally used in indoor and outdoor HVAC&R units. For example, the aluminum alloys disclosed herein are suitable substitutes for the copper conventionally used in components of HVAC&R systems, for example copper tubing. The aluminum alloys described herein provide better corrosion performance and provide material costs savings as compared to copper. As non-limiting examples, round or micro-channel aluminum alloy tubes containing the aluminum alloys described herein can replace round copper tubes in HVAC&R indoor and outdoor units.

The aluminum alloys provided herein display high strength and corrosion resistance. In some examples, the aluminum alloys described herein comprise the following, all in weight %: Cu: about 0.01%-about 0.60%, Fe: about 0.05%-about 0.40%, Mg: about 0.05%-about 0.8%, Mn: about 0.001%-about 2.0%, Si: about 0.05%-about 0.25%, Ti: about 0.001%-about 0.20%, Zn: about 0.001%-about 0.20%, Cr: 0%-about 0.05%, Pb: 0%-about 0.005%, Ca: 0%-about 0.03%, Cd: 0%-about 0.004%, Li: 0%-about 0.0001%, and Na: 0%-about 0.0005%. Other elements may be present as impurities at levels of 0.03% individually, with the total impurities not to exceed 0.10%. The remainder is aluminum. In some examples, the aluminum alloys described herein comprise the following, all in weight %: Cu: about 0.05%-about 0.10%, Fe: about 0.27%-about 0.33%, Mg: about 0.46%-about 0.52%, Mn: about 1.67%-about 1.8%, Si: about 0.17%-about 0.23%, Ti: about 0.12%-about 0.17%, Zn: about 0.12%-about 0.17%, Cr: 0%-about 0.01%, Pb: 0%-about 0.005%, Ca: 0%-about 0.03%, Cd: 0%-about 0.004%, Li: 0%-about 0.0001%, Na: 0%-about 0.0005%, other elements up to 0.03% individually and up to 0.10% total, and the remainder Al. In one case, the aluminum alloys contain: Cu: about 0.07%, Fe: about 0.3%, Mg: about 0.5%, Mn: about 1.73%, Si: about 0.2%, Ti: about 0.15%, Zn: about 0.15%, other elements 0.03% individually and 0.10% total, and the remainder aluminum.

Optionally, the aluminum alloys described herein have an electrical conductivity above 40% based on the international annealed copper standard (IACS) (e.g., about 41% based on the IACS). The aluminum alloys described herein can have a corrosion potential of about −735 mV. Optionally, the aluminum alloys described herein have a yield strength greater than about 130 MPa and an ultimate tensile strength greater than about 185 MPa. The aluminum alloys can be in an H temper or an O temper.

Also provided herein are methods of producing an aluminum alloy. The methods include the steps of casting an aluminum alloy as described herein to form a cast aluminum alloy, homogenizing the cast aluminum alloy, hot rolling the cast aluminum alloy to produce an intermediate gauge sheet, cold rolling the intermediate gauge sheet to produce a final gauge sheet, and optionally annealing the final gauge sheet.

Further provided herein are aluminum articles comprising an aluminum alloy as described herein. The aluminum articles can comprise a heat exchange component (e.g., at least one of a radiator, a condenser, an evaporator, an oil cooler, an inter cooler, a charge air cooler, or a heater core). Optionally, the heat exchanger component comprises a tube. The aluminum article can comprise an indoor HVAC&R unit or an outdoor HVAC&R unit. The aluminum article can comprise culvert stock, irrigation piping, or a marine vehicle.

Also provided herein are articles comprising a tube formed from an aluminum article as described herein and a fin formed from a 7xxx series aluminum alloy (e.g., AA7072) or from a 1xxx series aluminum alloy (e.g., AA1100), wherein the fin is joined to the tube by brazing.

Further aspects, objects, and advantages will become apparent upon consideration of the detailed description of non-limiting examples that follow.

DETAILED DESCRIPTION

Figure 1:
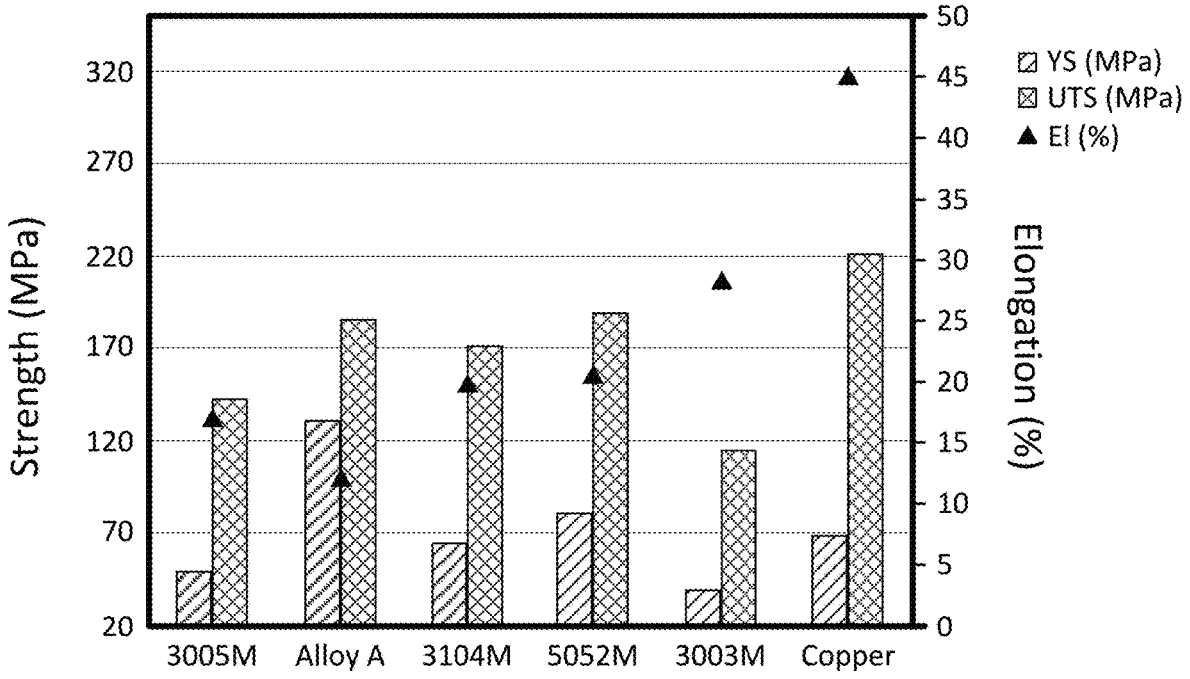
FIG. 1 is a chart showing the yield strength (YS), ultimate tensile strength (UTS), and elongation (EI) for exemplary Alloy A and comparison alloys.
Figure 2:
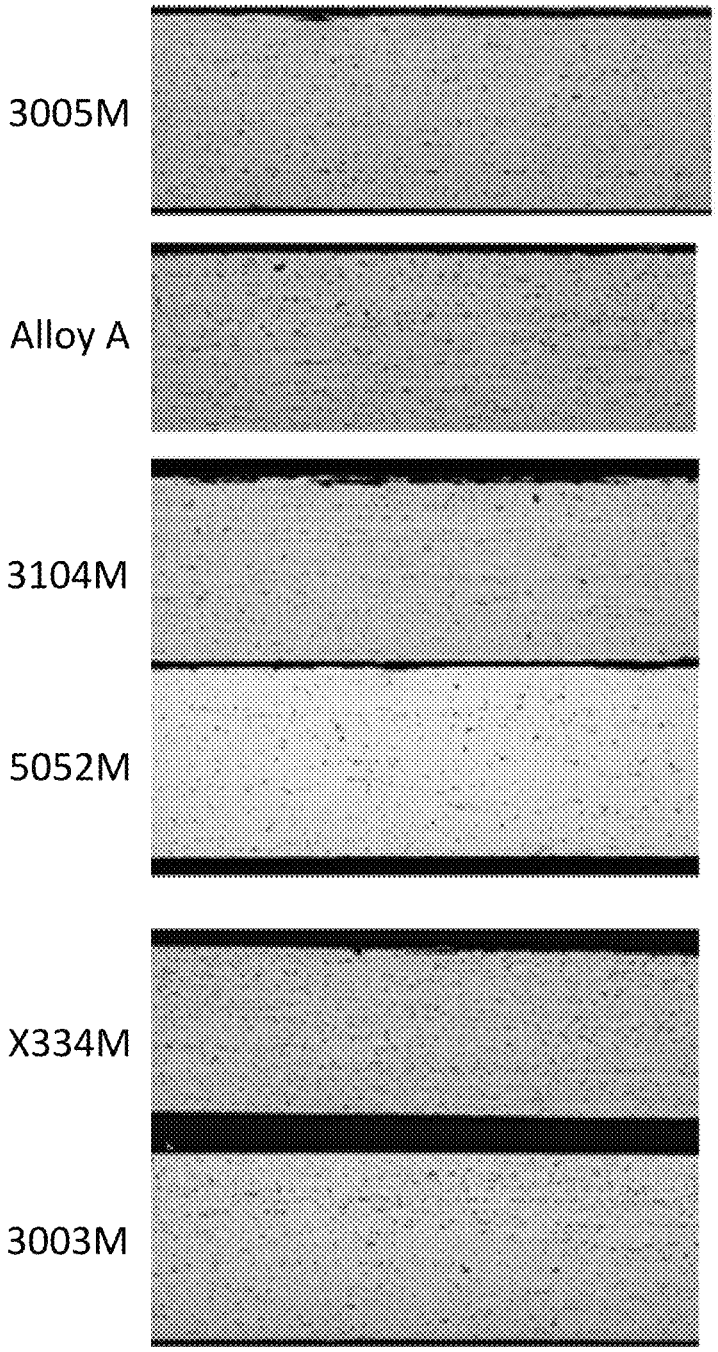
FIG. 2 shows pictures of exemplary Alloy A and comparison alloys after Sea Water Acetic Acid Testing (SWAAT) exposure for one week.
Figure 3:
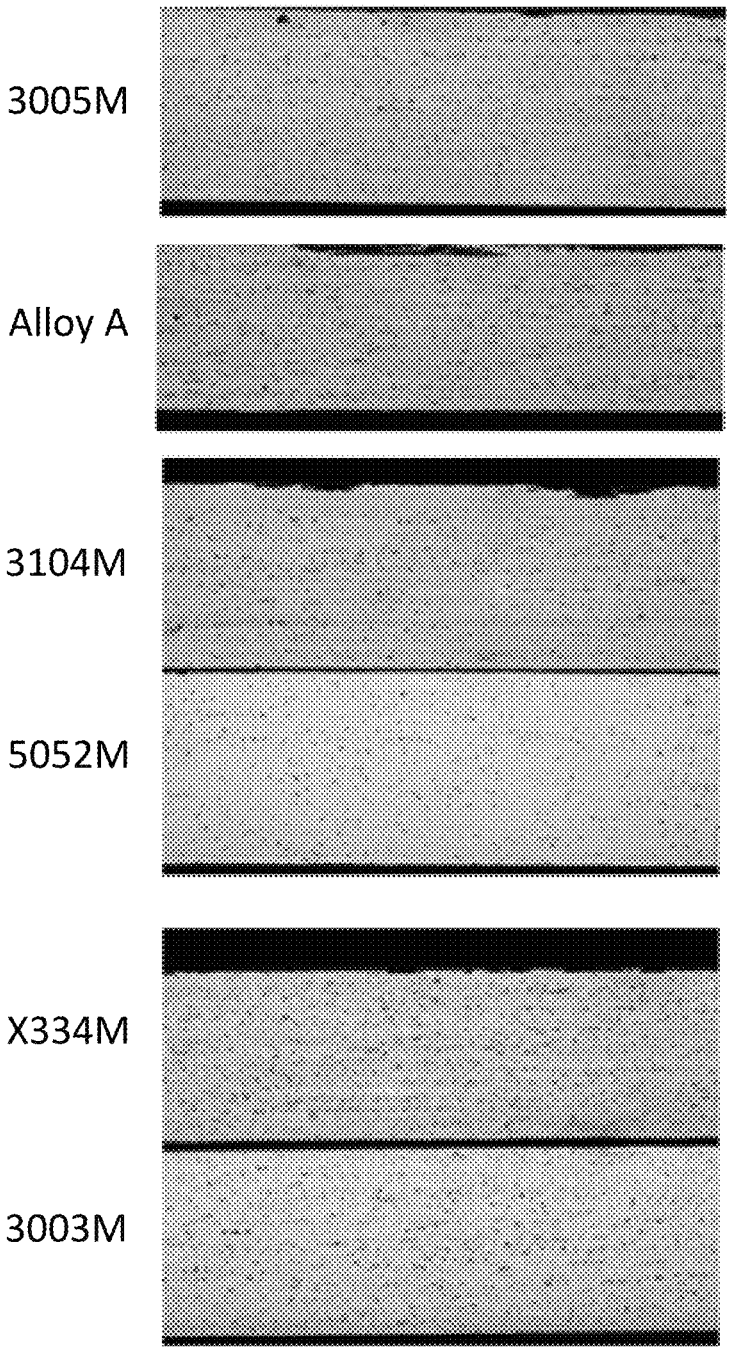
FIG. 3 shows pictures of exemplary Alloy A and comparison alloys after SWAAT exposure for one week.
Figure 4:
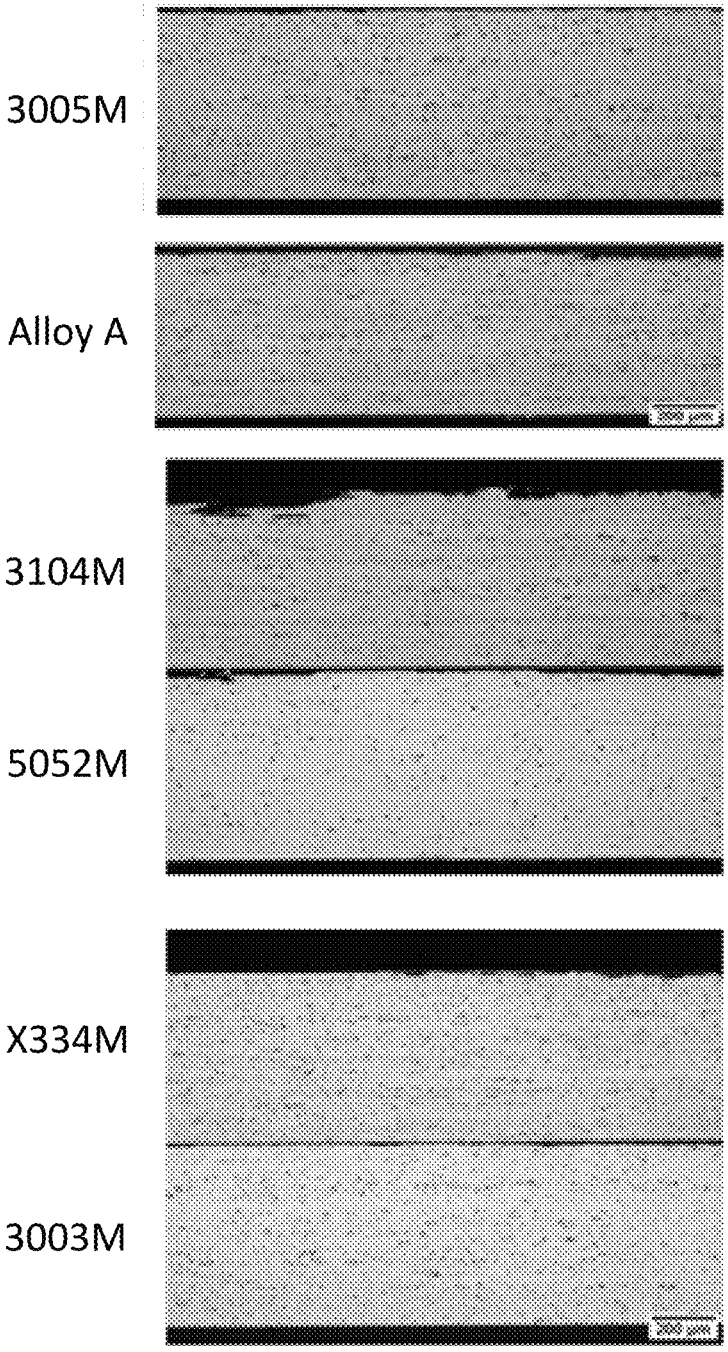
FIG. 4 shows pictures of exemplary Alloy A and comparison alloys after SWAAT exposure for one week.
Figure 5:
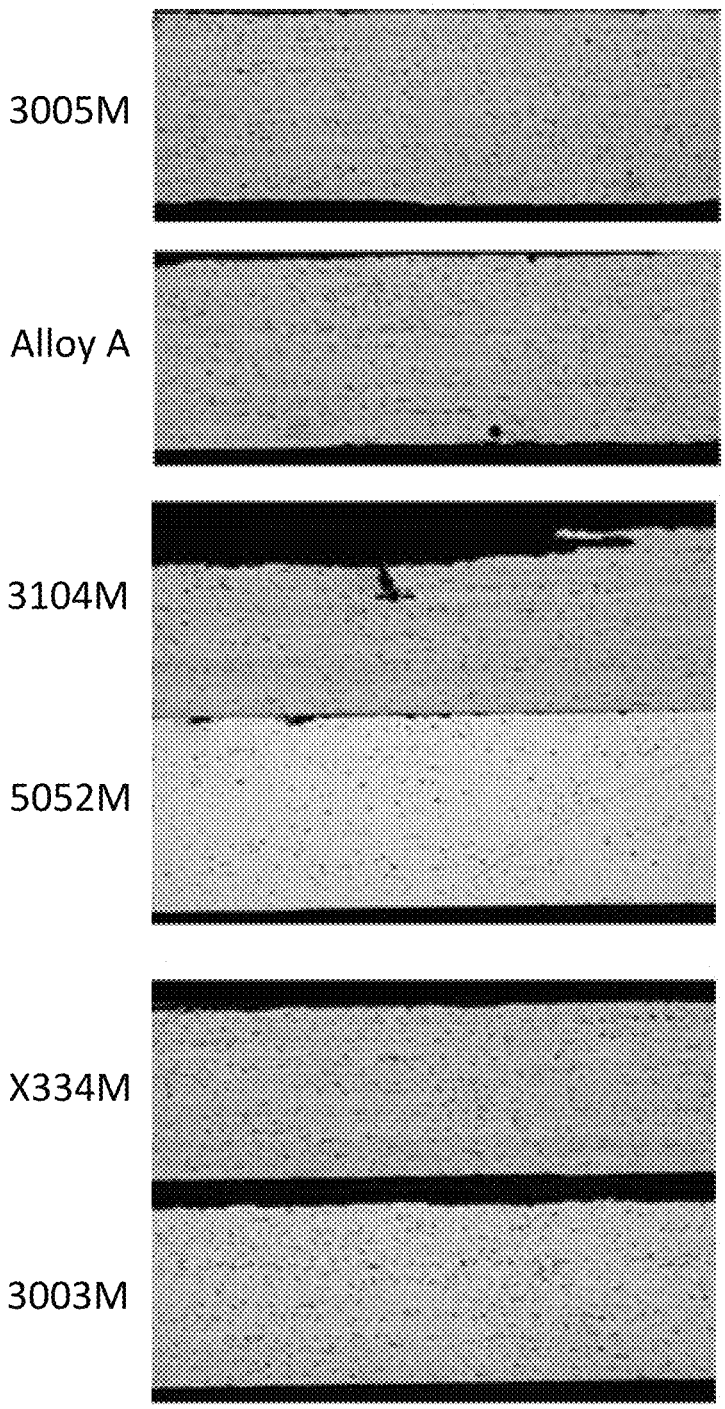
FIG. 5 shows pictures of exemplary Alloy A and comparison alloys after SWAAT exposure for four weeks.
Figure 6:
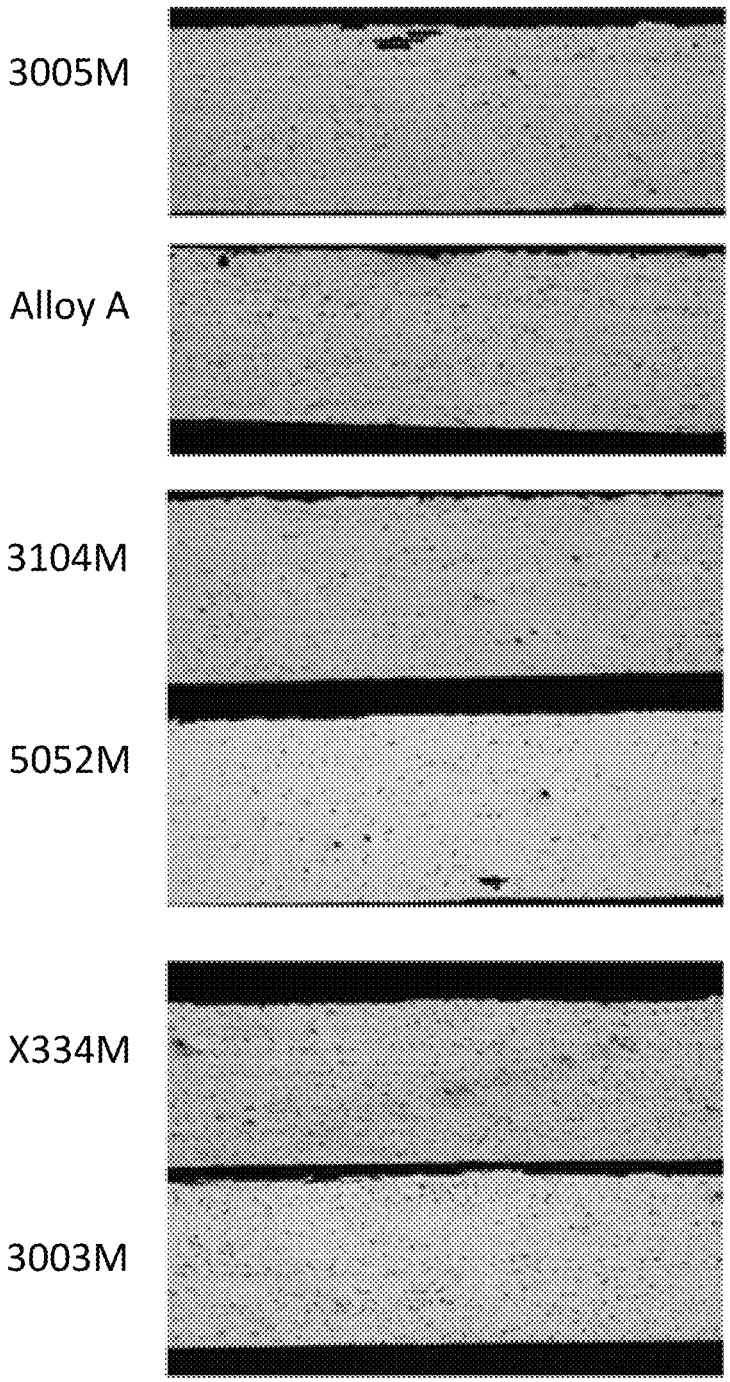
FIG. 6 shows pictures of exemplary Alloy A and comparison alloys after SWAAT exposure for four weeks.
Figure 7:
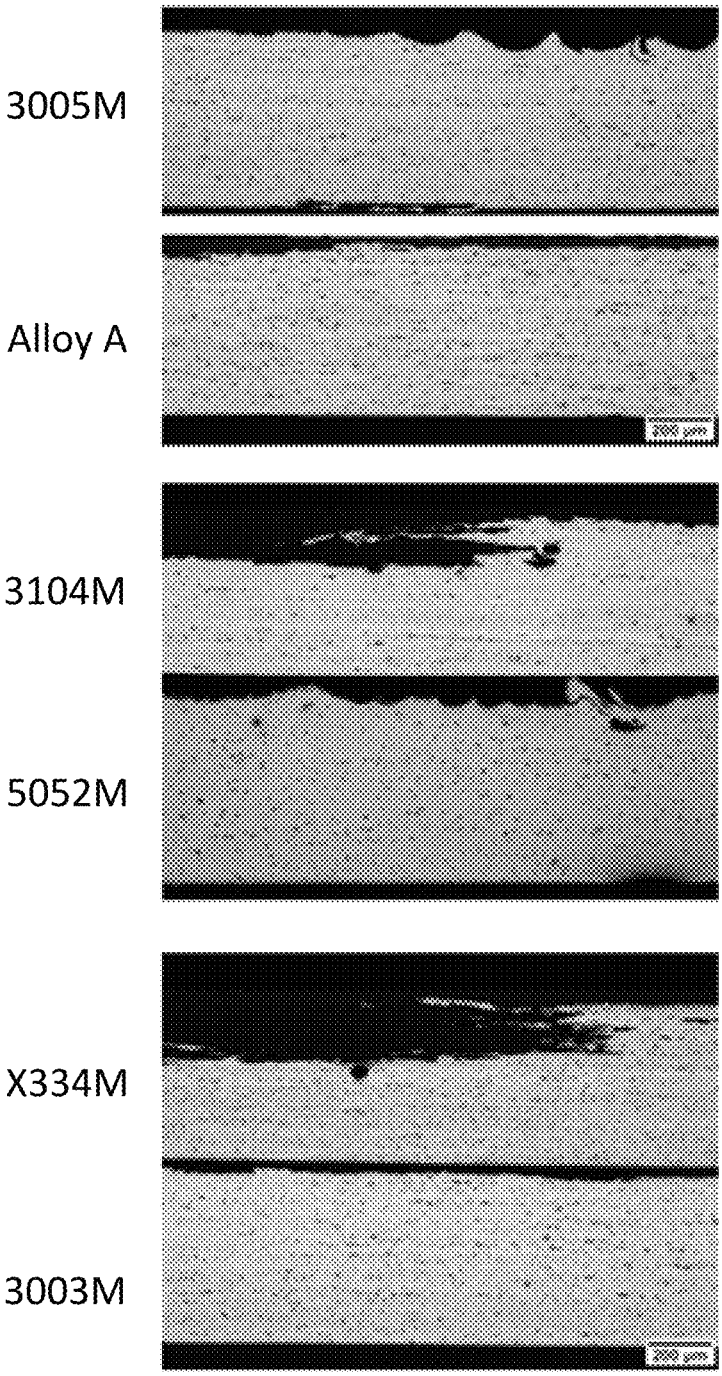
FIG. 7 shows pictures of exemplary Alloy A and comparison alloys after SWAAT exposure for four weeks.

Described herein are novel aluminum alloys and methods of using the alloys. The alloys described herein exhibit properties such that the alloys can replace copper (Cu) in any application for which copper is suitable. For example, the alloys described herein can replace the copper tubes traditionally used in HVAC&R systems, including tubes in indoor and outdoor HVAC&R units. The alloys also can be used to replace existing extruded alloys, and also can be used for other brazed applications such as radiators, condensers, oil coolers, and heater cores (e.g., when the magnesium (Mg) content is maintained at less than 0.5 wt. %). The alloys described herein can be cladded on one side or both sides and used in the above-mentioned applications. The alloys have longer life and higher strength than the clad and zinc coated aluminum tubes currently available as substitutes for copper tubing. Additionally, the alloys described herein can be used in general industrial applications, including culvert stock and irrigation piping. In some further examples, the alloys described herein can be used in transportation applications, for example, in marine vehicles (e.g., water craft vehicles), automobiles, commercial vehicles, aircraft, or railway applications. In still further examples, the alloy described herein can be used in electronics applications, for example in power supplies and heat sinks, or in any other desired application.

Definitions and Descriptions

As used herein, the terms "invention," "the invention," "this invention" and "the present invention" are intended to refer broadly to all of the subject matter of this patent application and the claims below. Statements containing these terms should be understood not to limit the subject matter described herein or to limit the meaning or scope of the patent claims below.

In this description, reference may be made to alloys identified by AA numbers and other related designations, such as "series" or "1xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," and "the" includes singular and plural references unless the context clearly dictates otherwise.

As used herein, the meaning of "outdoors" refers to a placement that is not fully contained within any structure produced by humans and that is exposed to geological and meteorological environmental conditions, such as air, solar radiation, wind, rain, sleet, snow, freezing rain, ice, hail, dust storms, humidity, aridity, smoke (e.g., tobacco smoke, house fire smoke, industrial incinerator smoke, and wild fire smoke), smog, fossil fuel exhaust, bio-fuel exhaust, salts (e.g., high salt content air in regions near a body of salt water), radioactivity, electromagnetic waves, corrosive gases, corrosive liquids, galvanic metals, galvanic alloys, corrosive solids, plasma, fire, electrostatic discharge (e.g., lightning), biological materials (e.g., animal waste, saliva, excreted oils, and vegetation), wind-blown particulates, barometric pressure change, and diurnal temperature change.

As used herein, the meaning of "indoors" refers to a placement contained within any structure produced by humans, optionally with controlled environmental conditions.

As used herein, the meaning of "room temperature" can include a temperature of from about 15° C. to about 30° C., for example about 15° C., about 16° C., about 17° C., about 18° C., about 19° C., about 20° C., about 21° C., about 22° C., about 23° C., about 24° C., about 25° C., about 26° C., about 27° C., about 28° C., about 29° C., or about 30° C.

Reference is made in this application to alloy temper or condition. For an understanding of the alloy temper descriptions most commonly used, see "American National Standards (ANSI) H35 on Alloy and Temper Designation Systems." An F condition or temper refers to an aluminum alloy as fabricated. An O condition or temper refers to an aluminum alloy after annealing. An Hxx condition or temper, also referred to herein as an H temper, refers to an aluminum alloy after cold rolling with or without thermal treatment (e.g., annealing). Suitable H tempers include HX1, HX2, HX3 HX4, HX5, HX6, HX7, HX8, or HX9 tempers.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g., 1 to 6.1, and ending with a maximum value of 10 or less, e.g., 5.5 to 10.

Alloy Compositions

Described herein are aluminum alloys that have high corrosion resistance and high strength. The aluminum alloys and their components are described in terms of their elemental composition in weight percent (wt. %). In each alloy, the remainder is aluminum, with a maximum wt. % of 0.1% for the sum of all impurities.

In some examples, the alloys disclosed herein contain the following, all in weight %: copper (Cu): about 0.01%-about 0.60% (e.g., about 0.01%-about 0.6%, about 0.05%-about 0.6%, about 0.05%-about 0.55%, about 0.05%-about 0.50%, about 0.05%-about 0.40%, or about 0.05%-about 0.30%); iron (Fe): about 0.05%-about 0.40% (e.g., about 0.1%-about 0.4%, about 0.2%-about 0.4%, about 0.05%-about 0.33%, about 0.2%-about 0.33%, or about 0.27%-about 0.33%); magnesium (Mg): about 0.05%-about 0.8% (e.g., about 0.1%-about 0.8%, about 0.3%-about 0.8%, about 0.3%-about 0.6%, about 0.3%-about 0.52%, about 0.46%-about 0.52%, or about 0.46%-about 0.8%); manganese (Mn): about 0.001%-about 2.0% (e.g., about 0.1%-about 2.0%, about 0.5%-about 2.0%, about 1.0%-about 2.0%, about 1.5%-about 2.0%, about 0.5%-about 1.8%, about 1.0%-about 1.8%, about 1.5%-about 1.8%, or about 1.67%-about 1.8%); silicon (Si): about 0.05%-about 0.25% (e.g., about 0.10%-about 0.30%, about 0.10%-about 0.23%, about 0.17%-about 0.30%, or about 0.17%-about 0.23%); titanium (Ti): about 0.001%-about 0.22% (e.g., about 0.01%-about 0.20%, about 0.05%-about 0.20%, about 0.1%-about 0.20%, about 0.12%-about 0.20%, about 0.01%-about 0.17%, about 0.5%-about 0.17%, about 0.1%-about 0.17%, or about 0.12%-about 0.17%); zinc (Zn): about 0.001%-about 0.22% (e.g., about 0.01%-about 0.20%, about 0.05%-about 0.20%, about 0.1%-about 0.20%, about 0.12%-about 0.20%, about 0.01%-about 0.17%, about 0.5%-about 0.17%, about 0.1%-about 0.17%, or about 0.12%-about 0.17%); chromium (Cr): 0%-about 0.05% (e.g., 0%-about 0.01%); lead (Pb): 0%-about 0.01% (e.g., 0%-about 0.005%); calcium (Ca): 0%-about 0.06% (e.g., 0%-about 0.03%); cadmium (Cd): 0%-about 0.01% (e.g., 0%-about 0.004%, 0%-about 0.006%, 0%-about 0.008%, about 0.001%-about 0.004%, about 0.001%-about 0.006%, about 0.001%-about 0.008%, or about 0.001%-about 0.01%); lithium (Li): 0%-about 0.001% (e.g., 0%-about 0.0001%, 0%-about 0.0004%, 0%-about 0.0008%, about 0.00005%-about 0.0001%, about 0.00005%-about 0.0004%, about 0.00008%-about 0.0001%, or about 0.00005%-about 0.001%); and sodium (Na): 0%-about 0.001% (e.g., 0%-about 0.0005%, 0%-about 0.0007%, or about 0.001%-about 0.0005%, about 0.001%-about 0.007%). Other elements may be present as impurities at levels of 0.03% individually, with the total impurities not to exceed 0.10%. The remainder is aluminum.

In some cases, the alloys contain the following, all in weight %: Cu: about 0.01%-about 0.60%, Fe: about 0.05%-about 0.40%, Mg: about 0.05%-about 0.8%, Mn: about 0.001%-about 2.0%, Si: about 0.05%-about 0.25%, Ti: about 0.001%-about 0.20%, Zn: about 0.001%-about 0.20%, Cr: 0%-about 0.05%, Pb: 0%-about 0.005%, Ca: 0%-about 0.03%, Cd: 0%-about 0.004%, Li: 0%-about 0.0001%, and Na: 0%-about 0.0005%. Other elements may be present as impurities at levels of 0.03% individually, with the total impurities not to exceed 0.10%. The remainder is aluminum.

In some examples, the alloys contain the following, all in weight %: Cu: about 0.05%-about 0.30%, Fe: about 0.27%-about 0.33%, Mg: about 0.46%-about 0.52%, Mn: about 1.67%-about 1.8%, Si: about 0.17%-about 0.23%, Ti: about 0.12%-about 0.17%, Zn: about 0.12%-about 0.17%, Cr: 0%-about 0.01%, Pb: 0%-about 0.005%, Ca: 0%-about 0.03%, Cd: 0%-about 0.004%, Li: 0%-about 0.0001%, and Na: 0%-about 0.0005%. Other elements may be present as impurities at levels of 0.03% individually, with the total impurities not to exceed 0.10%. The remainder is aluminum.

In one case, the alloys contain Cu: about 0.07%, Fe: about 0.3%, Mg: about 0.5%, Mn: about 1.73%, Si: about 0.2%, Ti: about 0.15%, Zn: about 0.15%, other elements 0.03% individually and 0.10% total, with the remainder being aluminum.

In some examples, the alloys described herein include copper (Cu) in an amount of from 0.01%-0.60%. For example, the alloys can include about 0.01%, about 0.02%, about 0.03%, about 0.04%, about 0.05%, about 0.06%, about 0.07%, about 0.08%, about 0.09%, about 0.10%, about 0.11%, about 0.12%, about 0.13%, about 0.14%, about 0.15%, about 0.16%, about 0.17%, about 0.18%, about 0.19%, about 0.20%, about 0.21%, about 0.22%, about 0.23%, about 0.24%, about 0.25%, about 0.26%, about 0.27%, about 0.28%, about 0.29%, about 0.30%, about 0.31%, about 0.32%, about 0.33%, about 0.34%, about 0.35%, about 0.36%, about 0.37%, about 0.38%, about 0.39%, about 0.40%, about 0.41%, about 0.42%, about 0.43%, about 0.44%, about 0.45%, about 0.46%, about 0.47%, about 0.48%, about 0.49%, about 0.50%, about 0.51%, about 0.52%, about 0.53%, about 0.54%, about 0.55%, about 0.56%, about 0.57%, about 0.58%, about 0.59%, or about 0.60% Cu. In some examples, Cu, in solid solution, can increase the strength of the aluminum alloys described herein. Cu typically does not form coarse precipitates in aluminum alloys; however, Cu can precipitate at hot rolling or annealing temperatures (e.g., about 300° C.-about 500° C.), depending upon the concentration of Cu present. Under equilibrium conditions and with a Cu content as described herein (e.g., about 0.6 wt. %), Cu reduces the solid solubility of Mn by forming an intermetallic AlMnCu phase. The AlMnCu particle growth occurs during the homogenization of a cast aluminum alloy and prior to hot rolling, under the conditions further described below.

In some examples, the alloys described herein include iron (Fe) in an amount of from about 0.05%-about 0.40%. For example, the alloys can include about 0.05%, about 0.06%, about 0.07%, about 0.08%, about 0.09%, about 0.10%, about 0.11%, about 0.12%, about 0.13%, about 0.14%, about 0.15%, about 0.16%, about 0.17%, about 0.18%, about 0.19%, about 0.20%, about 0.21%, about 0.22%, about 0.23%, about 0.24%, about 0.25%, about 0.26%, about 0.27%, about 0.28%, about 0.29%, about 0.30%, about 0.31%, about 0.32%, about 0.33%, about 0.34%, about 0.35%, about 0.36%, about 0.37%, about 0.38%, about 0.39%, or about 0.40% Fe. In some examples, Fe can be a part of intermetallic constituents which can contain Mn, Si and other elements. Incorporating Fe in the amounts described herein can control formation of coarse intermetallic constituents.

In some examples, the alloys described herein include magnesium (Mg) in an amount from about 0.05%-about 0.8%. For example, the alloys can include about 0.05%, about 0.06%, about 0.07%, about 0.08%, about 0.09%, about 0.10%, about 0.11%, about 0.12%, about 0.13%, about 0.14%, about 0.15%, about 0.16%, about 0.17%, about 0.18%, about 0.19%, about 0.20%, about 0.21%, about 0.22%, about 0.23%, about 0.24%, about 0.25%, about 0.26%, about 0.27%, about 0.28%, about 0.29%, about 0.30%, about 0.31%, about 0.32%, about 0.33%, about 0.34%, about 0.35%, about 0.36%, about 0.37%, about 0.38%, about 0.39%, about 0.40%, about 0.41%, about 0.42%, about 0.43%, about 0.44%, about 0.45%, about 0.46%, about 0.47%, about 0.48%, about 0.49%, about 0.50%, about 0.51%, about 0.52%, about 0.53%, about 0.54%, about 0.55%, about 0.56%, about 0.57%, about 0.58%, about 0.59%, about 0.60%, about 0.61%, about 0.62%, about 0.63%, about 0.64%, about 0.65%, about 0.66%, about 0.67%, about 0.68%, about 0.69%, about 0.70%, about 0.71%, about 0.72%, about 0.73%, about 0.74%, about 0.75%, about 0.76%, about 0.77%, about 0.78%, about 0.79%, or about 0.80% Mg. In some examples, Mg can increase the strength of the aluminum alloy via solid solution strengthening. Mg can coordinate with Si and Cu present in the aluminum alloys described herein, providing an age-hardenable alloy. In some cases, large amounts of Mg (e.g., above the ranges recited herein) can reduce corrosion resistance of an aluminum alloy and can lower a melting temperature of the aluminum alloy. Therefore, Mg should be present in the amounts described herein to increase strength without decreasing corrosion resistance and without lowering the melting temperature of the aluminum alloy.

In some examples, the alloys described herein include manganese (Mn) in an amount from about 0.001%-about 2.0%. For example, the alloys can include about 0.001%, about 0.005%, about 0.01%, about 0.05%, about 0.1%, about 0.5%, about 1.0%, about 1.1%, about 1.2%, about 1.3%, about 1.4%, about 1.5%, about 1.6%, about 1.65%, about 1.66%, about 1.67%, about 1.68%, about 1.69%, about 1.70%, about 1.71%, about 1.72%, about 1.73%, about 1.74%, about 1.75%, about 1.76%, about 1.77%, about 1.78%, about 1.79%, about 1.80%, about 1.81%, about 1.82%, about 1.83%, about 1.84%, about 1.85%, about 1.86%, about 1.87%, about 1.88%, about 1.89%, about 1.9%, about 1.91%, about 1.92%, about 1.93%, about 1.94%, about 1.95%, about 1.96%, about 1.97%, about 1.98%, about 1.99%, or about 2.0% Mn. Mn can increase strength of aluminum via solid solution strengthening. Mn can form dispersions of intermetallic compounds with aluminum. Higher Mn content, for example, in combination with Fe amounts as described herein, can lead to the formation of coarse Mn—Fe intermetallic constituents.

In some examples, the alloys described herein include silicon (Si) in an amount of about 0.05%-about 0.25%. For example, the alloy can include about 0.05%, about 0.06%, about 0.07%, about 0.08%, about 0.09%, about 0.10%, about 0.11%, about 0.12%, about 0.13%, about 0.14%, about 0.15%, about 0.16%, about 0.17%, about 0.18%, about 0.19%, about 0.20%, about 0.21%, about 0.22%, about 0.23%, about 0.24%, or about 0.25% Si. The Si content is carefully controlled, as the Si content can lower the melting temperature of the aluminum alloys as described herein. Including Si in amounts as described herein can lead to the formation of AlMnSi dispersoids, resulting in improved strength of the aluminum alloys.

In some examples, the alloys described herein include titanium (Ti) in an amount of about 0.001%-about 0.20%. For example, the alloys can include about 0.001%, about 0.005%, about 0.010%, about 0.05%, about 0.10%, about 0.11%, about 0.12%, about 0.13%, about 0.14% about 0.15%, about 0.16%, about 0.17%, about 0.18%, about 0.19%, or about 0.20% Ti. When included in the amounts described herein, Ti improves the corrosion resistance of the aluminum alloys described herein. In some cases, Ti is incorporated in the amounts described herein to maintain the ductility of the aluminum alloys. When used in amounts higher than those described herein, Ti may impair the ductility of the formed alloy, which is necessary for the fabrication of certain products, such as tubes.

In some examples, the alloys described herein include zinc (Zn) in an amount of about 0.001%-about 0.20%. For example, the alloys can include about 0.001%, about 0.005%, about 0.010%, about 0.05%, about 0.10%, about 0.11%, about 0.12%, about 0.13%, about 0.14% about 0.15%, about 0.16%, about 0.17%, about 0.18%, about 0.19%, or about 0.20% Zn. In some examples, Zn included in the alloy at a concentration as described herein can remain in solid solution and increase corrosion resistance. In some cases, Zn incorporated at a concentration greater than about 0.20% can increase intergranular corrosion or can accelerate corrosion, for example, under the galvanic coupling conditions.

In some examples, the alloys described herein include chromium (Cr) in an amount from 0%-about 0.05%. For example, the alloys can include about 0.001%, about 0.002%, about 0.003%, about 0.004%, about 0.005%, about 0.006%, about 0.007%, about 0.008%, about 0.009%, about 0.01%, about 0.02%, about 0.03%, about 0.04%, or about 0.05% Cr. In some examples, Cr is not present (i.e., 0%).

In some examples, the alloys described herein include lead (Pb) in an amount of from 0%-about 0.005%. For example, the alloys can include about 0.001%, about 0.002%, about 0.003%, about 0.004%, or about 0.005% Pb. In some examples, Pb is not present (i.e., 0%).

In some examples, the alloys described herein include calcium (Ca) in an amount from 0%-about 0.03%. For example, the alloys can include about 0.01%, about 0.02%, or about 0.03% Ca. In some examples, Ca is not present (i.e., 0%).

In some examples, the alloys described herein include cadmium (Cd) in an amount from 0%-about 0.004%. For example, the alloys can include about 0.001%, about 0.002%, about 0.003%, or about 0.004% Cd. In some examples, Cd is not present (i.e., 0%).

In some examples, the alloys described herein include lithium (Li) in an amount from 0%-about 0.0001%. For example, the alloys can include about 0.00005% or about 0.0001% Li. In some examples, Li is not present (i.e., 0%).

In some examples, the alloys described herein include sodium (Na) in an amount from 0%-about 0.001%. For example, the alloys can include about 0.0001%, about 0.0002%, about 0.0003%, about 0.0004%, about 0.0005%, or about 0.001% Na. In some examples, Na is not present (i.e., 0%).

Alloy Properties

The alloys described herein have a high work hardening rate. The strength of the alloy in as-rolled temper is significantly higher, making the alloy useful for applications that do not require formability. The alloy can be used with or without a clad layer.

The alloys disclosed herein are well-suited for replacing copper in a variety of applications including plumbing applications, HVAC&R applications, automotive applications, industrial applications, transportation applications, electronics applications, aerospace applications, railway applications, packaging applications, or others. The alloys described herein can be used, for example, in HVAC&R equipment, including in heat exchangers. When formed into tubes, the components typically are mechanically assembled with a small area on the end, which is flame brazed to a return bend. The flame brazing demands that the tube have a significantly higher solidus temperature than the filler material so the tube does not melt with the filler material used in brazing. The alloy described herein has good mechanical and chemical properties, including a high solidus temperature, making it useable with different types of brazing fillers.

The alloys described herein have a corrosion resistance sufficient to pass a 28 day Sea Water Acetic Acid Testing (SWAAT) corrosion test. When the alloys are formed into heat exchanger tubing, including micro-port tubing, they produce sufficient corrosion resistance on their own, thereby eliminating any need for the conventional zinc thermo-spraying step.

When combined with a fin material of a 1xxx series or 7xxx series aluminum alloy, the alloys described herein have better corrosion resistance than copper. The fin material is sacrificial to the tube. The alloys described herein outperform copper in SWAAT corrosion testing. As shown in the Examples, samples of the inventive alloy with a fin formed from a 1xxx series or 7xxx series aluminum alloy have limited or no corrosion to the inventive alloy. However, samples of copper with a fin formed from a 1xxx series or 7xxx series aluminum alloy result in significant corrosion to the copper after two weeks of exposure.

Methods of Preparing and Processing

Casting

The alloy described herein can be cast using a casting method as known to those of skill in the art. For example, the casting process can include a Direct Chill (DC) casting process. The DC casting process is performed according to standards commonly used in the aluminum industry as known to one of skill in the art. Optionally, the casting process can include a continuous casting (CC) process. The casting process can optionally include any other commercial casting process using roller casting. Optionally, the cast aluminum alloy can be scalped. The cast aluminum alloy can then be subjected to further processing steps. For example, the processing methods as described herein can include the steps of homogenization, hot rolling, cold rolling, and/or annealing.

Homogenization

The homogenization step can include heating a cast aluminum alloy as described herein to attain a homogenization temperature of about, or at least about, 480° C. For example, the cast aluminum alloy can be heated to a temperature of at least about 480° C., at least about 490° C., at least about 500° C., at least about 510° C., at least about 520° C., at least about 530° C., at least about 540° C., at least about 550° C., or anywhere in between. In some cases, the heating rate to the homogenization temperature can be about 100° C./hour or less, about 75° C./hour or less, about 50° C./hour or less, about 40° C./hour or less, about 30° C./hour or less, about 25° C./hour or less, about 20° C./hour or less, about 15° C./hour or less, or about 10° C./hour or less.

The cast aluminum alloy is then allowed to soak (i.e., held at the indicated temperature) for a period of time. According to one non-limiting example, the cast aluminum alloy is allowed to soak for up to about 10 hours (e.g., from about 10 minutes to about 10 hours, inclusively). For example, the cast aluminum alloy can be soaked at a temperature of at least 520° C. for 10 minutes, 20 minutes, 30 minutes, 1 hour, 2 hours, 3 hours, 4 hours, 5 hours, 6 hours, 7 hours, 8 hours, 9 hours, 10 hours, or anywhere in between.

Hot Rolling

Following the homogenization step, a hot rolling step can be performed to produce an intermediate gauge product (e.g., a sheet or a plate). In certain cases, the cast aluminum alloy can be hot rolled to an about 2 mm to about 15 mm thick gauge (e.g., from about 2.5 mm to about 10 mm thick gauge). For example, the cast aluminum alloy can be hot rolled to an about 2 mm thick gauge, about 2.5 mm thick gauge, about 3 mm thick gauge, about 3.5 mm thick gauge, about 4 mm thick gauge, about 5 mm thick gauge, about 6 mm thick gauge, about 7 mm thick gauge, about 8 mm thick gauge, about 9 mm thick gauge, about 10 mm thick gauge, about 11 mm thick gauge, about 12 mm thick gauge, about 13 mm thick gauge, about 14 mm thick gauge, or about 15 mm thick gauge.

Cold Rolling

A cold rolling step can be performed following the hot rolling step. In certain aspects, the intermediate gauge sheet from the hot rolling step can be cold rolled to a final gauge sheet. In certain aspects, the rolled product is cold rolled to a thickness of about 0.2 mm to about 2.0 mm, about 0.3 mm to about 1.5 mm, or about 0.4 mm to about 0.8 mm. In certain aspects, the intermediate gauge sheet is cold rolled to about 2 mm or less, about 1.5 mm or less, about 1 mm or less, about 0.5 mm or less, about 0.4 mm or less, about 0.3 mm or less, about 0.2 mm or less, or about 0.1 mm or less. For example, the intermediate gauge product can be cold rolled to about 0.1 mm, about 0.2 mm, about 0.3 mm, about 0.4 mm, about 0.5 mm, about 0.6 mm, about 0.7 mm, about 0.8 mm, about 0.9 mm, about 1.0 mm, about 1.1 mm, about 1.2 mm, about 1.3 mm, about 1.4 mm, about 1.5 mm, about 1.6 mm, about 1.7 mm, about 1.8 mm, about 1.9 mm, or about 2.0 mm, or anywhere in between.

Annealing

Depending on final temper requirements, the method can include an optional subsequent annealing step. The annealing step can be performed on the final gauge aluminum alloy sheet or after a final pass on a cold rolling mill. The annealing step can include heating the sheet from room temperature to a temperature of from about 230° C. to about 370° C. (e.g., from about 240° C. to about 360° C., from about 250° C. to about 350° C., from about 265° C. to about 345° C., or from about 270° C. to about 320° C.). The sheet can soak at the temperature for a period of time. In certain aspects, the sheet is allowed to soak for up to approximately 6 hours (e.g., from about 10 seconds to about 6 hours, inclusively). For example, the sheet can be soaked at the temperature of from about 230° C. to about 370° C. for about 15 seconds, about 30 seconds, about 45 seconds, about 1 minute, about 5 minutes, about 10 minutes, about 15 minutes, about 20 minutes, about 30 minutes, about 1 hour, about 2 hours, about 3 hours, about 4 hours, about 5 hours, about 6 hours, or anywhere in between. In some examples, the sheet is not annealed.

Methods of Using

The alloys and methods described herein can be used in industrial applications including sacrificial parts, heat dissipation, packaging, and building materials. The alloys described herein can be employed as industrial fin stock for heat exchangers. The industrial fin stock can be provided such that it is more resistant to corrosion than currently employed industrial fin stock alloys (e.g., AA7072 and AA1100) and will still preferentially corrode protecting other metal parts incorporated in a heat exchanger. The aluminum alloys disclosed herein are suitable substitutes for metals conventionally used in indoor and outdoor HVAC&R units. The aluminum alloys described herein provide better corrosion performance and higher strength as compared to alloys currently employed.

The alloys described herein can replace copper in any application for which copper is suitable. For example, the alloys disclosed herein can be used as round tubes to substitute round copper tubes, with or without a clad layer. An alternative approach is to substitute multi-port extrusion (MPE) aluminum tubes, which are also referred to as a micro-channel tubes, for round copper tubes. The micro-channel tube is also referred to as a brazed aluminum heat exchanger.

The following examples will serve to further illustrate the present invention without, however, constituting any limitation thereof. On the contrary, it is to be clearly understood that resort may be had to various embodiments, modifications and equivalents thereof which, after reading the description herein, may suggest themselves to those skilled in the art without departing from the spirit of the invention. During the studies described in the following examples, conventional procedures were followed, unless otherwise stated. Some of the procedures are described below for illustrative purposes.

EXAMPLES

Materials

The compositions of the five alloys used in the following experimental sections are presented in Table 1, with the remainder being aluminum. The composition range for inventive exemplary alloy A was within the following specification: 1.7-1.8% Mn, 0.46-0.52% Mg, 0.05-0.07% Cu, 0.27-0.33% Fe, 0.17-0.23% Si, 0.12-0.17% Ti, 0.12-0.17% Zn, unavoidable impurities, with the remainder Al.

The following fabrication procedure was used for the alloys. An ingot produced by DC casting was scalped and thereafter heated to 520° C. in 12 hours. The ingot soaked at 520° C. for 6 hours. The ingot was hot rolled to 2.5 mm gauge. The hot rolled sheet was subsequently cold rolled to the required final gauge thickness of 0.4 to 0.8 mm. All samples were tested in the fully annealed condition. The samples compared were all in O temper.

TABLE 1

| | | | | | | | | Impurities | |
|---|---|---|---|---|---|---|---|---|---|
| Alloy | Cu | Fe | Mg | Mn | Si | Ti | Zn | Each | Total |
| Alloy A | 0.07 | 0.3 | 0.5 | 1.7 | 0.2 | 0.15 | 0.15 | 0.05 | 0.15 |
| 3005M | 0.07 | 0.3 | 0.5 | 1 | 0.2 | 0.15 | 0.15 | 0.05 | 0.15 |
| 3104M | 0.07 | 0.3 | 1 | 1 | 0.2 | 0.15 | 0.15 | 0.05 | 0.15 |
| 5052M | 0.07 | 0.12 | 2.5 | 0.07 | 0.15 | 0.15 | 0.15 | 0.05 | 0.15 |
| 3003M | 0.08 | 0.3 | | 1.4 | 0.5 | 0.15 | 0.15 | 0.05 | 0.15 |

Example 1: Mechanical Properties of the Alloys

Mechanical properties were determined for sheets of exemplary alloy A and several comparison alloys. The testing was carried out with the alloys in O temper. The samples were manufactured as per ASTM B557 standards. Three samples were tested from each alloy variant and the average values were reported. In order to acquire consistent results, the samples were manufactured to edge roughness of 0.5 Ra. Exemplary alloy A had an ultimate tensile strength (UTS) of ~175 MPa. All but one of the comparison alloys had UTS lower than that of exemplary alloy A. FIG. 1 shows UTS for exemplary alloy A and the comparison alloys. Exemplary alloy A had a yield strength (YS) of about 75 MPa. All but one of the comparison alloys had YS lower than that of exemplary alloy A. YS test results are also shown in FIG. 1. Exemplary alloy A had a percent elongation (EI) of about 15%, as shown in FIG. 1.

Example 2: Corrosion Properties

A fin of aluminum alloy AA7072 was used to evaluate corrosion values for exemplary alloy A and the comparison alloys. The open circuit potential corrosion values ("corrosion potentials") were measured using ASTM G69. Exemplary alloy A had a corrosion potential of −735 mV, which was similar to the corrosion potentials of the other alloys tested. Table 2 shows the results of this test for all alloys. The difference in corrosion potential between aluminum tube alloy and fin alloy is expected to be below 150 mV in order for the fin to act sacrificially and protect the tube from corrosion.

Conductivity was tested pursuant to the International Annealed Copper Standard (IACS). Exemplary alloy A had an average conductivity about 43.4% based on IACS, which is sufficient to provide good heat transfer in the unit. Table 2 includes IACS data for all alloys tested.

Differential scanning calorimetry (DSC) was used to determine the solidus and liquidus temperatures for exemplary alloy A as well as the comparison alloys and a known filler material, 718 AlSi. Those temperatures as well as the difference between the alloy solidus and the 718 AlSi filler liquidus are shown in Table 2. The temperatures reported here are normalized against a 99.999% pure aluminum alloy. The larger the difference between an alloy solidus and filler liquidus, the more stable is an industrial joining process involving the filler material. Higher solidus temperature of exemplary alloy A is required so that the tube does not melt during brazing to another component of the heat exchanger unit. The delta between exemplary alloy A solidus and 718 AlSi liquidus is 65° C., which is suitable for joining processes, such as flame brazing.

TABLE 2

| | Electrical conductivity (% IACS) | Corrosion Potential (mV) | 7072 CP - Alloy CP (mV) | DSC Solidus (° C.) | DSC Liquidus (° C.) | Delta between Alloy Solidus - 718 AlSi Filler Liquidus (° C.) |
|---|---|---|---|---|---|---|
| Alloy | | | | | | |
| Alloy A | 43.4 | −735 | −151 | 647 | 655 | 65 |
| 3005M | 40.1 | −725 | −161 | 643 | 655 | 61 |
| 3104M | 37.2 | −722 | −164 | 631 | 655 | 49 |
| 5052M | 37.1 | −738 | −148 | 604 | 647 | 22 |
| 3003M | 46.7 | −726 | −160 | 647 | 656 | 65 |
| 7072 | 50.0 | −886 | | 650 | 662 | |
| 718AlSi Filler | | | | 576 | 582 | |

Example 3: Sea Water Acetic Acid (SWAAT) Corrosion Testing

Exemplary alloy A and comparison alloys 3005M, 3104M, 5052M, and 3003M were formed and tested with AA7072 clamped to the formed exemplary and comparison alloys (used to create a fin for evaluation of the alloys' corrosion performances under the SWAAT test). SWAAT was carried out according to ASTM G85 Annex 3. Synthetic sea water acidified to 2.8-3.0 pH (42 g/L syn. sea salt+10 mL/L glacial acetic acid) was used. The samples were subsequently cleaned in 50% nitric acid for 1 hour and examined for corrosion in three different locations.

FIGS. 2-7 show results of a SWAAT test for exemplary alloy A and the comparison alloys after 1 week (FIGS. 2, 3, and 4) and 4 weeks (FIGS. 5, 6, and 7) of exposure. In FIGS. 2, 3, 5, and 6, only the top surfaces were in contact with the fin. Only areas under the fin are considered for corrosion evaluation. After one week (FIGS. 2, 3, and 4), few alloys exhibited corrosion activity, and the activity was more intense in areas away from the clamps. After four weeks (FIGS. 5, 6, and 7), the alloys showed some corrosion activity in the areas under the fin and away from the clamps. As shown in FIGS. 2-7, exemplary alloy A exhibited much less pitting corrosion compared to the other alloys tested.

A qualitative scale was used to assess the severity of corrosion after the samples were subjected to SWAAT testing. The specimens were subjected to SWAAT (ASTM G85) corrosion testing for an exposure of 4 weeks and were examined to characterize the corrosion behavior after 1 and 4 weeks. The corrosion severity was characterized on a zero to ten scale with zero indicating high corrosion and ten indicating low or no corrosion. The corrosion resistance and strength results are presented in Table 3. The alloy compositions tested are shown in Table 1.

TABLE 3

| Alloy | Strength | Corrosion |
|---|---|---|
| Alloy A | 8 | 8 |
| 3005M | 5 | 7 |
| 3104M | 7 | 4 |
| 5052M | 10 | 8 |
| 3003M | 3 | 7 |

Based on the mechanical properties and corrosion testing, exemplary alloy A had the best overall combination of strength, corrosion resistance, chemical potential, and solidus temperature. Alloy 3005 had good corrosion resistance, but low mechanical properties. Alloy 3104 had good strength and formability, but had low corrosion resistance in areas away from the contact with the 7072 fin. Alloy 3104 also has high Mg content and low solidus temperature, which may be an issue during brazing. Alloy 5052 had an excellent combination of strength and corrosion resistance but very low solidus and very high Mg content, making it vulnerable to melting during flame brazing. Alloy 5052 also has poor weldability. Alloy 3003 had good corrosion resistance, but low strength.

Figure 8:
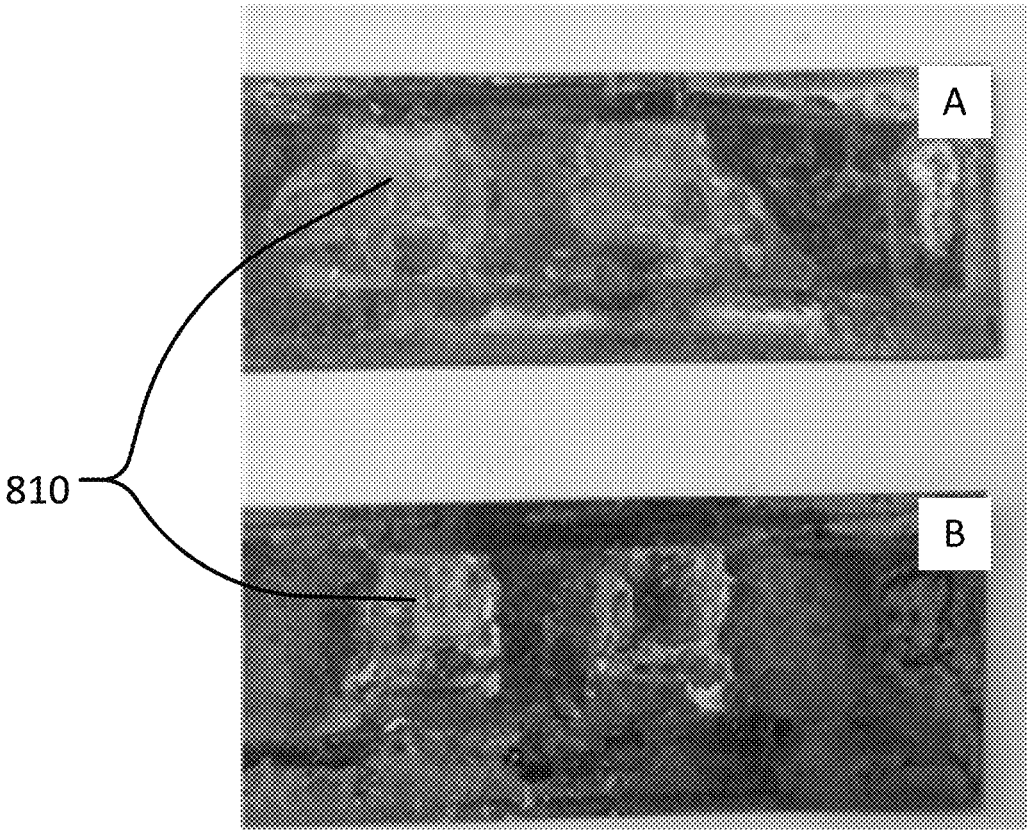
FIG. 8 shows pictures of copper coupled to an AA7072 fin (panel A) and copper coupled to an AA1100 fin (panel B) after SWAAT conditions exposure for four weeks.
Figure 9:
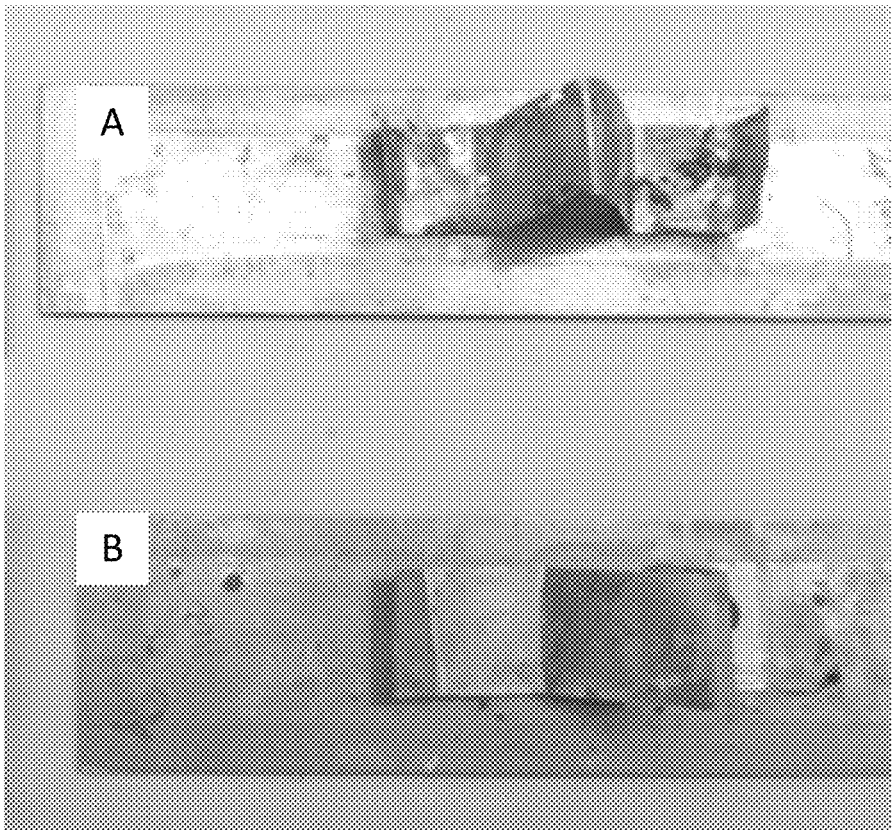
FIG. 9 shows pictures of exemplary Alloy A coupled to an AA7072 fin (panel A) and exemplary Alloy A coupled to an AA1100 fin (panel B) after SWAAT conditions exposure for four weeks.

SWAAT tests were also conducted (i) comparing a fin of AA7072 on exemplary alloy A and on copper and (ii) comparing a fin of AA1100 on exemplary alloy A and on copper. The results are shown in FIGS. 8 and 9. Only the areas under the fin were considered for corrosion analysis. FIG. 8 panel A shows the corrosion 810 of copper with an AA7072 fin. FIG. 8 panel B shows the corrosion 810 of copper with an AA1100 fin. FIG. 9 panel A shows the corrosion of exemplary alloy A with an AA7072 fin. FIG. 9 panel B shows the corrosion of exemplary alloy A with an AA1100 fin. The 7072 and 1100 fins on exemplary alloy A survived after 4 weeks exposure in a SWAAT solution. Copper coupled with 7072 and 1100 exhibited severe corrosion activity after two weeks of exposure in SWAAT solution and the fins were corroded completely, indicating the severe galvanic corrosion activity between copper tube and aluminum fin.

Example 4: Bendability Testing of Alloys

Figure 10:
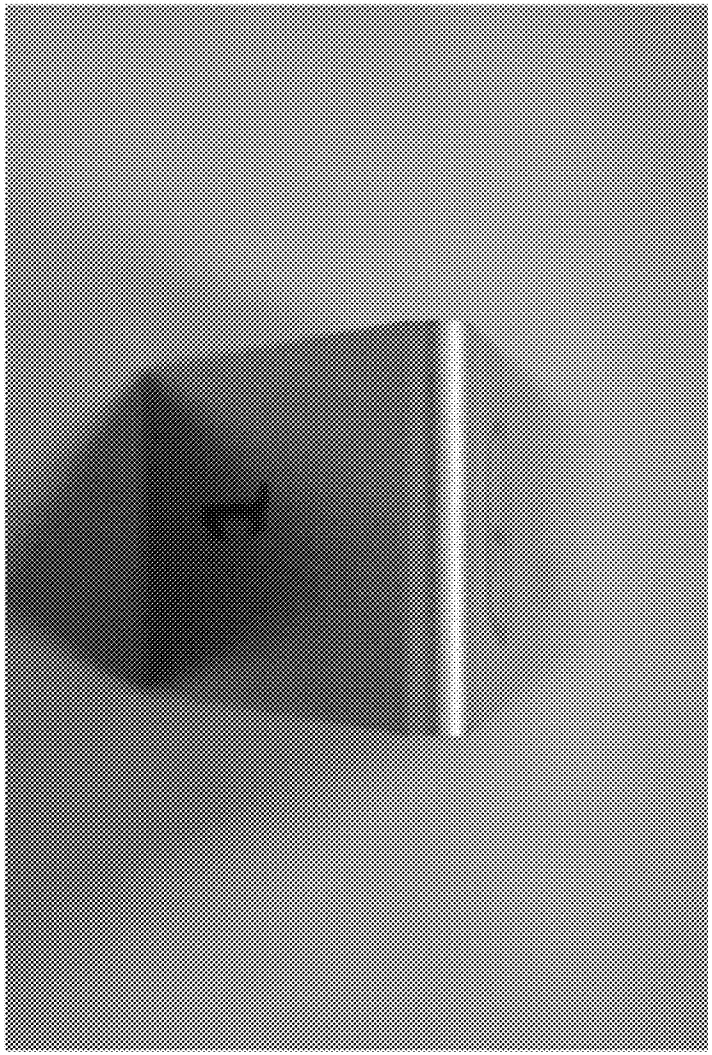
FIG. 10 is a digital image showing a sample without any cracks following a Wrap Bend test.
Figure 11:
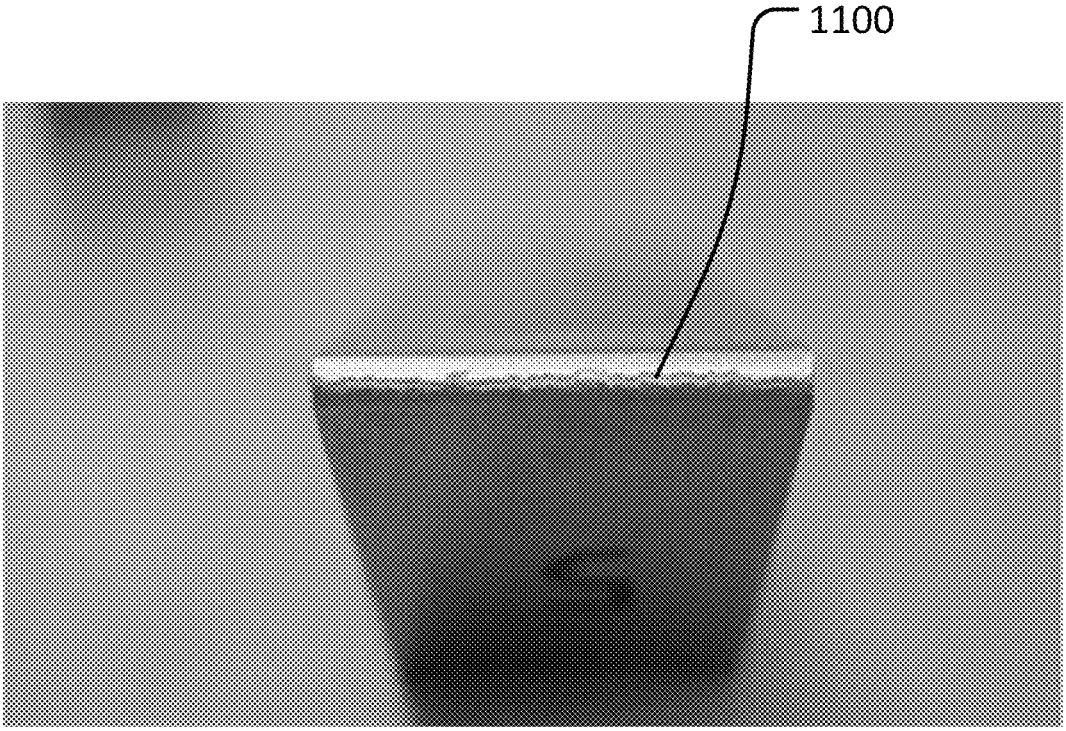
FIG. 11 is a digital image showing a sample containing cracks following a Wrap Bend test.

Bendability testing was conducted using the Wrap Bend test and the Flat Hem test. Wrap Bend tests were carried out on a 0.002 inch mandrel (sharpest radius) for bendability. The Flat Hem test is used to establish bendability of the alloy based on a complete 180° bend. The samples are ranked based on the bend surface appearance and the hem surface appearance; without cracks (see FIG. 10) or with cracks 1100 (see FIG. 11). Exemplary alloy A exhibited a good surface without any cracks and min R/T reported is 0.089 for the Wrap Bend test, wherein R indicates mandrel radius in inches and T is specimen thickness in inches. A bend surface rating (BSR) on a scale of one to five was assigned to the samples. Based on these results, exemplary alloy A exhibited superior bending performance compared to comparative tube stock alloys.

Formability testing was also conducted using the Erichsen test. The Erichsen test measures the formability of alloy under tri-axial loading. A punch is forced onto an aluminum sheet until cracks occur. Erichsen test results are reported in terms of displacement in material before it fractures.

Annealed samples were subjected to Erichsen testing and the results are presented in Table 4 for exemplary alloy A and the comparative alloys. Based on these results, exemplary alloy A performs well in bending operations. The baseline for comparison to exemplary alloy A is the 5052M alloy. 5052M has a good combination of strength and corrosion resistance, however, due to its high Mg content, brazing is problematic. 5052M has a low difference between alloy solidus and filler liquidus, which causes problems with flame brazing, i.e., the alloy will melt with the filler. There is a larger difference between alloy solidus and filler liquidus for exemplary alloy A and filler materials, so exemplary alloy A provides a more stable industrial process.

TABLE 4

| Alloy | Erichsen Dome Height (in) |
|---|---|
| 3005M | 0.348 |
| Alloy A | 0.322 |
| 3104M | 0.303 |
| 5052M | 0.322 |
| 3003M | 0.378 |

All patents, patent applications, publications, and abstracts cited above are incorporated herein by reference in their entireties. Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the invention as defined in the following claims.

What is claimed is:

1. An aluminum alloy comprising the following composition: Cu: 0.01 wt. %-0.35 wt. %, Fe: 0.05 wt. %-0.40 wt. %, Mg: 0.61 wt. %-0.8 wt. %, Mn: 1.65 wt. %-2.0 wt. %, Si: 0.05 wt. %-0.25 wt. %, Ti: 0.001 wt. %-0.20 wt. %, Zn: 0.001 wt. %-0.20 wt. %, Cr: 0 wt. %-0.05 wt. %, Pb: 0 wt. %-0.005 wt. %, Ca: 0 wt. %-0.03 wt. %, Cd: 0 wt. %-0.004 wt. %, Li: 0 wt. %-0.0001 wt. %, Na: 0 wt. %-0.0005 wt. %, other elements up to 0.03 wt. % individually and up to 0.10% total, and Al, wherein the aluminum alloy is in an H temper.

2. The aluminum alloy of claim 1, wherein an electrical conductivity of the aluminum alloy is above 40% based on the international annealed copper standard (IACS).

3. The aluminum alloy of claim 2, wherein an electrical conductivity of the aluminum alloy is 41% based on the IACS.

4. The aluminum alloy of claim 1, wherein a corrosion potential of the aluminum alloy is −735 mV.

5. The aluminum alloy of claim 1, wherein the aluminum alloy comprises a yield strength greater than 130 MPa and an ultimate tensile strength greater than 185 MPa.

6. An aluminum article comprising an aluminum alloy of claim 1.

7. The aluminum article of claim 6, wherein the aluminum article comprises a heat exchanger component.

8. The aluminum article of claim 7, wherein the heat exchanger component comprises at least one of a radiator, a condenser, an evaporator, an oil cooler, an inter cooler, a charge air cooler, or a heater core.

9. The aluminum article of claim 7, wherein the heat exchanger component comprises a tube.

10. The aluminum article of claim 6, wherein the aluminum article comprises an indoor heating, ventilating, air-conditioning, and refrigeration (HVAC&R) unit.

11. The aluminum article of claim 6, wherein the aluminum article comprises an outdoor HVAC&R unit.

12. The aluminum article of claim 6, wherein the aluminum article comprises culvert stock, irrigation piping, or a marine vehicle.

13. A method of producing an aluminum alloy, comprising:

casting an aluminum alloy according to claim 1 to form a cast aluminum alloy;

homogenizing the cast aluminum alloy;

hot rolling the cast aluminum alloy to produce an intermediate gauge sheet;

cold rolling the intermediate gauge sheet to produce a final gauge sheet; and annealing the final gauge sheet.

14. An aluminum alloy article comprising an aluminum alloy having the following composition: Cu: 0.01 wt. %-0.09 wt. %, Fe: 0.05 wt. %-0.40 wt. %, Mg: 0.61 wt. %-0.8 wt. %, Mn: 1.65 wt. %-2.0 wt. %, Si: 0.05 wt. %-0.25 wt. %, Ti: 0.001 wt. %-0.20 wt. %, Zn: 0.001 wt. %-0.20 wt. %, Cr: 0 wt. %-0.05 wt. %, Pb: 0 wt. %-0.005 wt. %, Ca: 0 wt. %-0.03 wt. %, Cd: 0 wt. %-0.004 wt. %, Li: 0 wt. %-0.0001 wt. %, Na: 0 wt. %-0.0005 wt. %, other elements up to 0.03 wt. % individually and up to 0.10% total, and Al, wherein the aluminum alloy article comprises an indoor heating, ventilating, air-conditioning, and refrigeration (HVAC&R) unit, an outdoor HVAC&R unit, a culvert stock, an irrigation piping, or a marine vehicle.

* * * * *